United States Patent [19]

Chastain

[11] Patent Number: 4,796,394

[45] Date of Patent: Jan. 10, 1989

[54] GEODESIC STRUCTURE

[76] Inventor: Lemuel J. Chastain, 8201 Fourth Ave., Brooklyn, N.Y. 11209

[21] Appl. No.: 119,969

[22] Filed: Nov. 13, 1987

[51] Int. Cl.[4] ..... E04B 1/32

[52] U.S. Cl. ..... 52/81; 52/DIG. 10

[58] Field of Search ..... 52/81, DIG. 10

[56] References Cited

U.S. PATENT DOCUMENTS

| | | | |
|---|---|---|---|
| 1,734,954 | 11/1929 | Arvidson | 52/DIG. 10 |
| 2,682,235 | 6/1954 | Fuller | 52/DIG. 10 |
| 2,905,113 | 9/1959 | Fuller | 52/81 |
| 4,296,869 | 10/1981 | Jawad | 52/81 |
| 4,548,004 | 10/1985 | Chastain | 52/81 |
| 4,682,450 | 7/1987 | Diamond | 52/81 |

*Primary Examiner*—Henry E. Raduazo
*Attorney, Agent, or Firm*—Natter & Natter

[57] ABSTRACT

A geodesic structure which can be adapted for various applications such as a vessel for underwater exploration or as a capsule for use in space flight or as a space station, includes a plurality of concentric, surface layers defining cellular enclosures. Each layer is comprised of planar panel members approximating a polyhedral surface. The respective polyhedral surfaces of each concentric layer are related through selected forms of geometric transformations such as truncations and stellations. Furthermore, each of the layers is structurally interconnected with adjacent layers above and below and also with several layers both above and below by a system of wedge members. Column members are optionally employed for spanning at least one intervening layer. The structure is provided with "growth" capabilities with additional concentric layers being readily incorporated in either a radially outward or a radially inward direction for expansion of the interior volume or for increasing structural integrity.

16 Claims, 5 Drawing Sheets

GEODESIC STRUCTURE

FIELD OF THE INVENTION

This invention relates generally to geodesic forms and especially to a mutually interdependent structural relationship of surfaces in space.

In particular, the invention concerns a multiple shell geodesic structure having concentric interconnected polyhedral surfaces defining cellular enclosures.

BACKGROUND ART

Geodesic dome constructions were generally used to provide unitary shell enclosures. In those constructions wherein the shell was comprised of rigid panels, the panels were frequently connected along abutting edges and included and underlying support network. The primary purpose of the panels was to provide a covering rather than to function as load transfer members.

A support system having plural layers of mutually dependent load bearing panel members was shown in U.S. Pat. No. 4,548,004. A disadvantage however, of that space frame was that the panel members could only be interconnected to panel members of an adjacent concentric layer which placed inherent restrictions upon the flexibility of the integral structural support system.

Another deficiency of that patented construction was that the relationship between the panel members of the adjacent layers was limited to duality i.e. the faces of the panels on one layer were placed in correspondence with the vertices of the panels of the adjacent layer.

A further shortcoming of that space frame construction was that it did not have any provision for the addition of new, concentric layers, either radially outwardly or inwardly, and thus did not have "growth" capabilities. Consequently, the structure could not be readily modified, for providing increased interior capacity or for adding structural strength and rigidity as may be required for particular applications of the structure.

SUMMARY OF THE INVENTION

The nature of this invention concerns a geodesic structure which utilizes the topology of concentric polyhedral surfaces for achieving structural integrity.

Briefly, the invention is directed to a multiple shell construction having a plurality of interdependent concentric polyhedral surfaces and a support network of wedge members and optional column members.

A parental polyhedral surface is derived from an approximation developed from a tessellation of geodesic polygons covering a curved surface without overlapping and without leaving any gaps. Additional tessellations formed on the same or alternate, nonintersecting curved surfaces provide companion tessellations. The substitution of planar polygons for the geodesic polygons of each of the curved surfaces provide polyhedral surfaces projected normally from the respective curved surfaces and present plural multifaceted planar surfaces defined by panel members. It should be noted however, that the panel members are separated along their respective confronting edges and thus provide access therebetween for accommodating intraspacial support members.

Further in accordance with this invention, the respective polyhedral surfaces are interrelated through a combination of different forms of stellations and truncations, as for example, are described in the publication entitled *Space Structures* by Arthur L. Loeb (1976) Addison Wesley, Reading, Mass.

By utilizing selected transformations and panel placement, the panel members within one polyhedral surface can be positioned in registration with and overlying the separation between panel members in a polyhedral surface below or above to thus achieve optimum structural integrity.

A feature of this invention therefore is that the relationship of one polyhedral surface with respect to another polyhedral surface is a geometrically definable transformation.

Another advantage of this invention is that the arrangement of the polyhedral surfaces provide concentric layers which are structurally united in a manner suitable for incorporating additional layers radially outwardly or radially inwardly of the structure.

A further improvement of this construction is that multiple layers can be connected directly not only to adjacent layers above and below, but to several layers both above and below and to remote layers and will thus advantageously transmit and disperse load bearing forces throughout the several layers.

In view of the foregoing, it should be apparent that the present invention overcomes many of the shortcomings of the prior art and provides a geodesic structure that is an improvement over previous constructions.

Having thus summarized the invention, it will be seen that it is an object thereof to provide an improved geodesic structure of the general character described herein which is not subject to the aforementioned disadvantages, shortcomings and deficiencies.

Specifically, it is an object of this invention to provide a geodesic structure having plural multifaceted interdependent surface layers related through truncation and stellation transformations.

Another object of the present invention is to provide a geodesic structure wherein additional surface layers can be selectively incorporated.

Yet another object of this invention is to provide for the selective interconnection of surface layers in a nonconsecutive order.

Still another object of this invention is to provide a geodesic structure wherein discrete surface panels on each of the multifaceted surface layers need not be joined along their respective abutting edges.

A further object of this invention is to provide a geodesic structure which is well adapted for practical applications.

Other objects, features and advantages of the invention will in part be obvious and in part will be pointed out hereinafter.

With these ends in view, the invention finds embodiment in certain combinations of elements and arrangements of parts by which the aforementioned objects and certain other objects are hereinafter attained all as more fully described with reference to the accompanying drawings and the scope of which is more particularly pointed out and indicated in the appended claims.

BRIEF DESCRIPTION OF THE DRAWINGS

In the accompanying drawings in which is shown a possible exemplary embodiment of the invention.

DESCRIPTION OF THE PREFERRED EMBODIMENT

Figure 1:
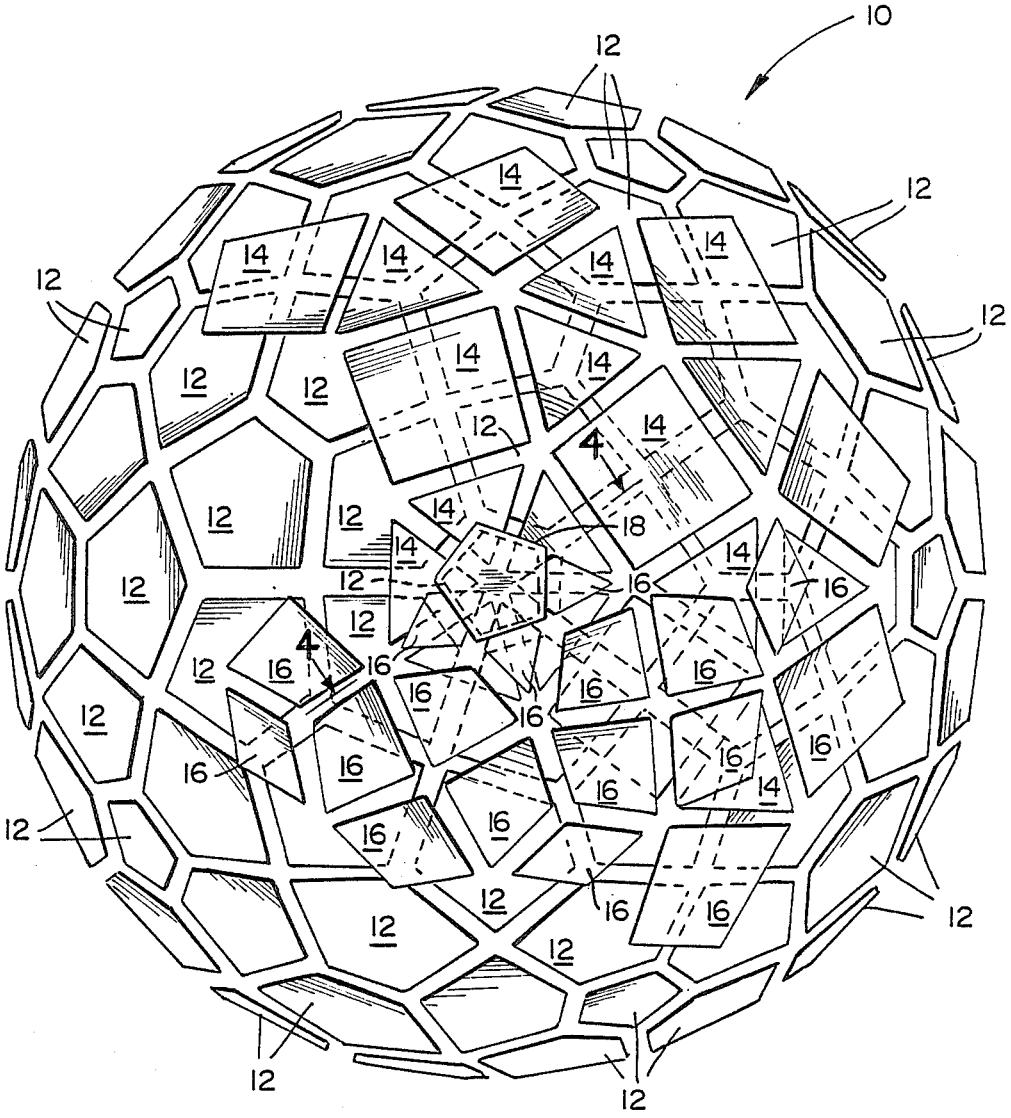
FIG. 1 is a plan view of a geodesic structure of this invention showing a parental polyhedral surface layer formed by a plurality of pentagonal panel members, and further illustrating overlying panel members within three additional concentric polyhedral surface layers.

Referring now in detail to the drawings, there is illustrated in FIG. 1 a plan view of a geodesic structure in accordance with this invention denoted generally by the reference numeral 10.

The geodesic structure 10 of this invention has general utility as an enclosure, and typically has a spherical shape although not limited to this form. The structure can be adapted for various applications such as a vessel for underwater exploration or as a capsule or pressurized cabin for use in space flight or as a space station above the earth's atmosphere.

The multi-layered construction provides for accretion layers to be added for increased structural integrity; as for example when subjected to extreme water pressure at great depths or for increasing the interior usable space. Furthermore, if one or more of the surface layers is damaged, the remaining layers can remain intact when constructed with cellular enclosures, for maintaining the internal pressure in either underwater or space environments.

Figure 2:
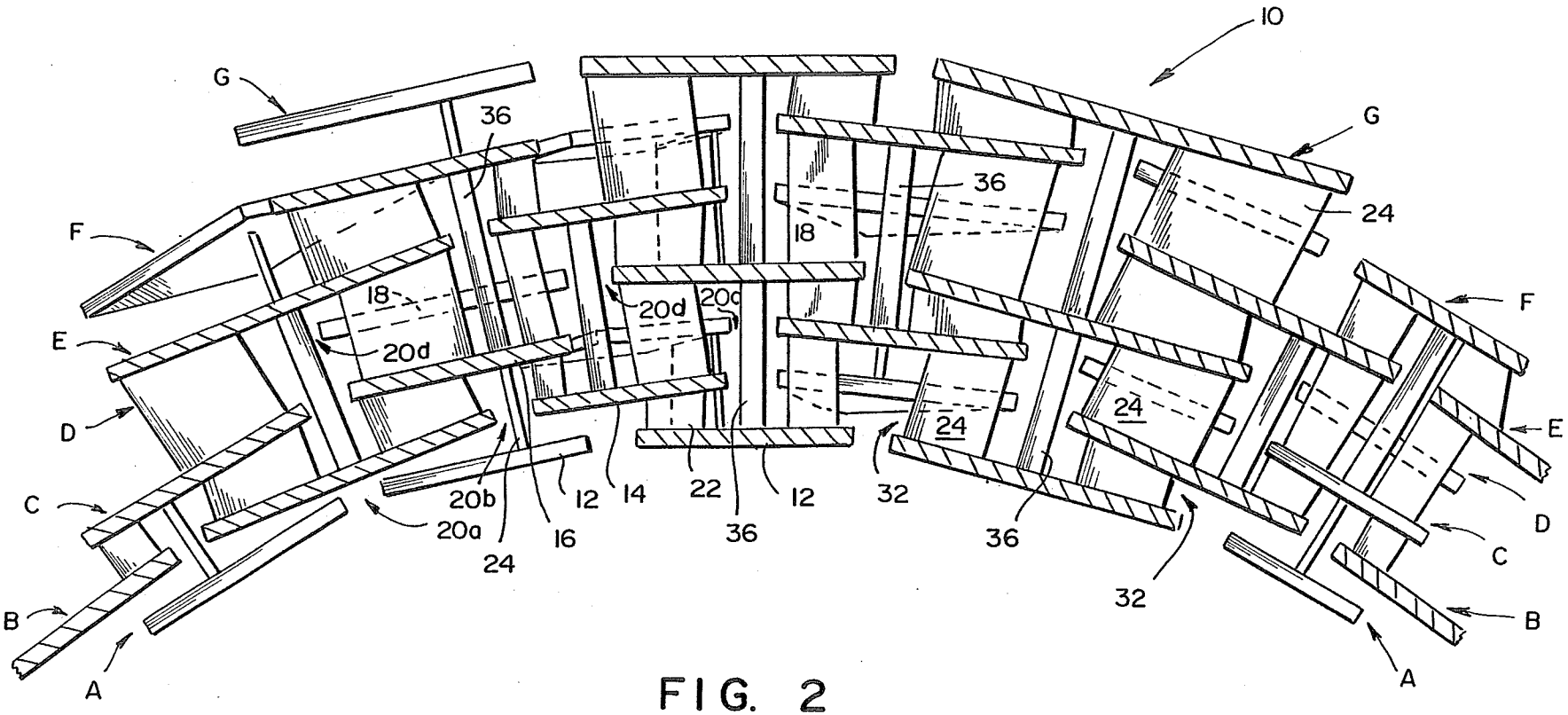
FIG. 2 is a sectional view to an enlarged scale illustrating the expansion capabilities and showing a plurality of seven polyhedral surface layers and a support network of wedge members and column members.

Referring now to the geodesic structure 10, a parental or innermost polyhedral layer A is formed by selecting a tessellation of any mathematically definable curved surface in three-dimensional space and by projecting a generated tessellation onto a plurality of approximating planar members. A second polyhedral layer B is positioned radially outward from and concentric with the layer A. A third polyhedral layer C is similarly positioned radially outward from and concentric with the layer B. In a similar manner, a series of consecutive layers D, E, F, and G are illustrated in FIG. 2. It should be understood that the concentric layers could also be placed radially inwardly of the layer A.

Figure 3:
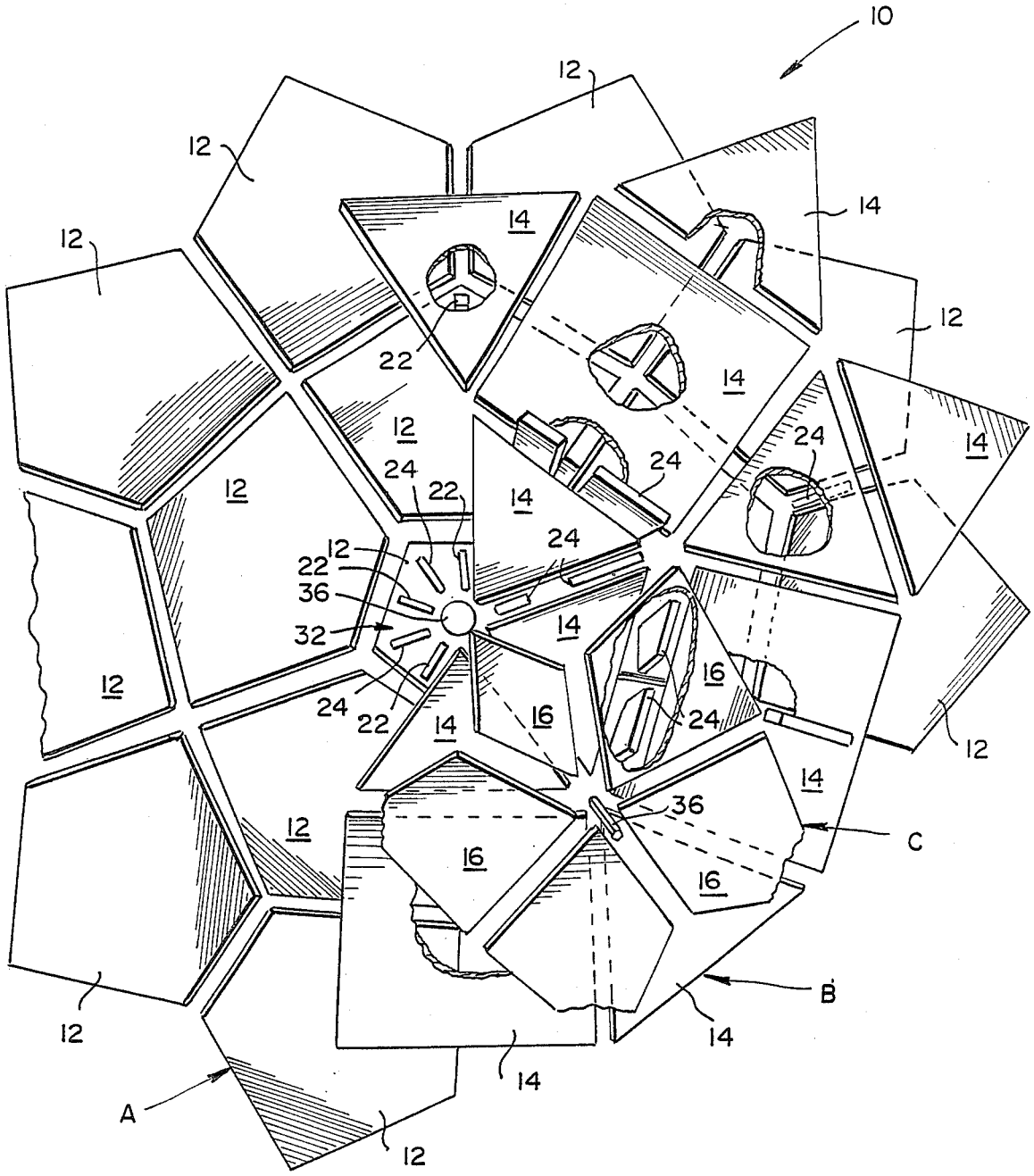
FIG. 3 is a perspective view of the structure shown in FIG. 1 to an enlarged scale detailing a portion of three consecutive polyhedral surface layers with the panel members broken-away for showing the spacial relationships between the panel members and the wedge and column members.

The layer A includes a plurality of regular and non-regular pentagonal planar panel members 12. The layer B includes a plurality of trapezoidal and triangular planar panel members 14. The layer C is comprised of a plurality of deltoidal i.e. kite-shaped, planar panel members 16 as shown in FIG. 3. The outermost layer D shown in FIG. 1 repeats on a larger scale, a plurality of regular and non-regular pentagonal planar panel members 18, as in layer A; but can also be a new polyhedron as derived from layer C. The layers E, F, and G are illustrated in FIG. 2 for the purpose of showing the crystal-like "growth" capabilities of the structure 10. It should be apparent that the number of panel members in the respective layers A, B, C, D, etc. tend to progressively increase with each successive radial outward layer; except when a prior layer is repeated on a larger scale. Although the tessellations forming each layer may be repeated, it is preferable to use at least three successive layers of different tessellations as is illustrated in the drawings.

Referring now to the respective layers A, B, C, and D, it should be noted that the planar polygon members 12, 14, 16, and 18 respectively are not in a contiguous abutting contract but rather provide an interspace 20*a*, 20*b*, 20*c* and 20*d*. The planar panel members 14 of the layer B overlie the interspace 20*a*, the planar members of the layer C overlie the interspace 20*b*, and the planar panel members 18 of the layer D overlie the interspace 20*c*. In addition, the planar panel members in the respective layers A, B, C, D are interrelated through geometric transformations such that the panel members 12, 14, 16 are inclined or non-parallel with respect to each other and the panel members 12 and 18 are parallel.

The support network will next be described. A plurality of wedge members 22, 24 are attached to the panel members 12 and are positioned around a central region of each panel and extend outwardly therefrom to the vertices and the edges of the panel 12. The wedge members 22, 24 are shown as so positioned on one of the panel members 12 in FIG. 3.

Figure 4:
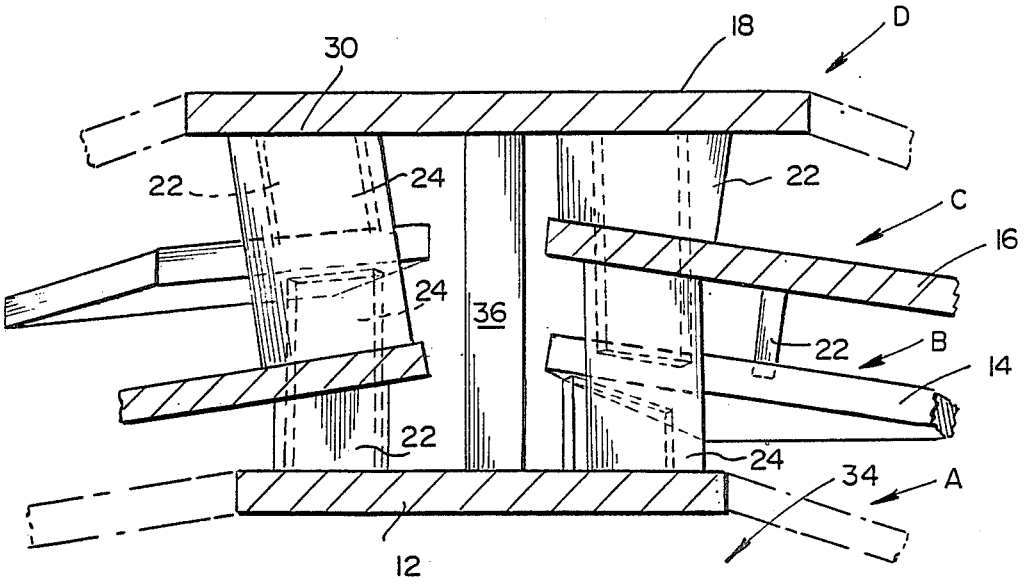
FIG. 4 is a sectional view to an enlarged scale, taken substantially along line 4—4 of FIG. 1 showing an arrangement of the wedge members and the column members for supporting the panel members of four consecutive polyhedral surface layers.
Figure 5:
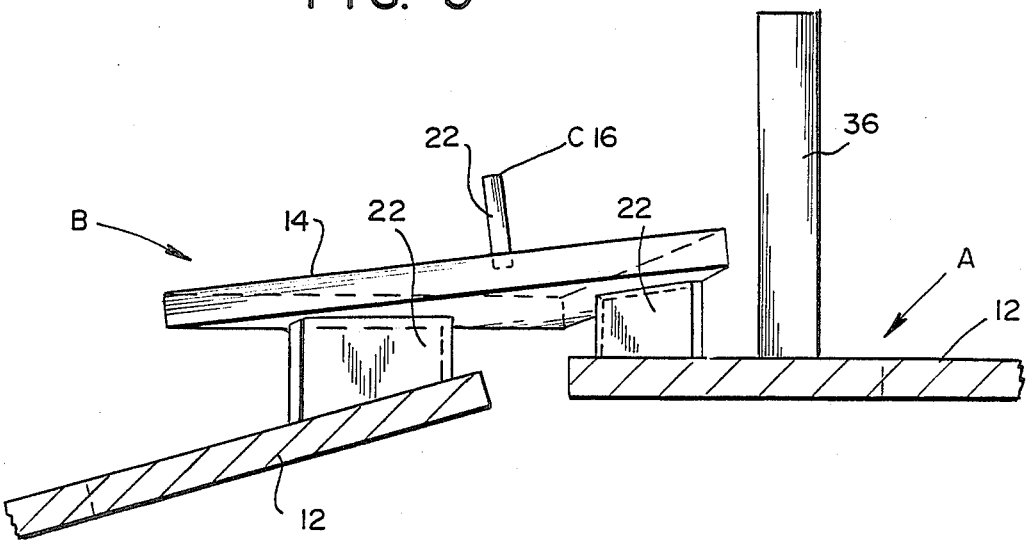
FIG. 5 is an isolated elevational view partially in perspective and partially in section, showing the wedge members and the column members.

Each of the wedge members 22 extends in a radial direction between the panel members of two of the respective layers, as for example, the layers A and B, and connect the panel members 12 and 14 as shown in FIGS. 4 and 5. In like manner, the panel members 14, 16 of the layers B and C are similarly connected by the wedge members 22.

The wedge members 24 pass through the interspace 20*b* and span the layer B to interconnect the panel members 12, 16 of the layers A, C. The panel members 14, 18 of the layers B, D are similarly connected as shown in FIGS. 2 and 4 using interspaces 20*c*.

It should be noted with regard to the wedge members 22, 24, that they connect panel members which do not lie in parallel planes. The inclination between respective panel members of corresponding layers can be measured by an angle of convergence. The wedge members are fabricated with two opposite sides inclined to coincide with the angle of convergence.

The wedge member connections to the panel members are generally referred to and described as progressing in a radially outward direction; and it should be understood that the geodesic structure 10 is also capable of a radially inward growth and that additional layers can also be added in this direction. Furthermore, the outermost layer D in the embodiment illustrated in FIG. 4, and the innermost layer A can be optionally provided with a continuous polyhedral layer by extending each of the panel members 12 and 18 respectively so that they are in abutting edge contact as shown by the broken-line illustration in FIG. 4. It should also be noted that the combination of the panel members in conjunction with the wedge members can form a plurality of enclosures or cells 32. The cells 32 are formed, for example, between the panel members 12 and 14, between the panel members 14 and 16, and between the panel members 16 and 18, by extending the ends of each of the adjacent wedge members 22, 24 into mating engagement with one another at the center of each panel. The wedge members 22, 24 are also dimensioned to extend to the peripheral edge of the panel members 12, 14, 16, 18 to mate with the wedge members 24 passing through intespaces 20*a–d*. The mating surfaces between the wedge members and the panel members can be fused hermetically. This will also increase the structural strength of the structure 10.

Figure 6:
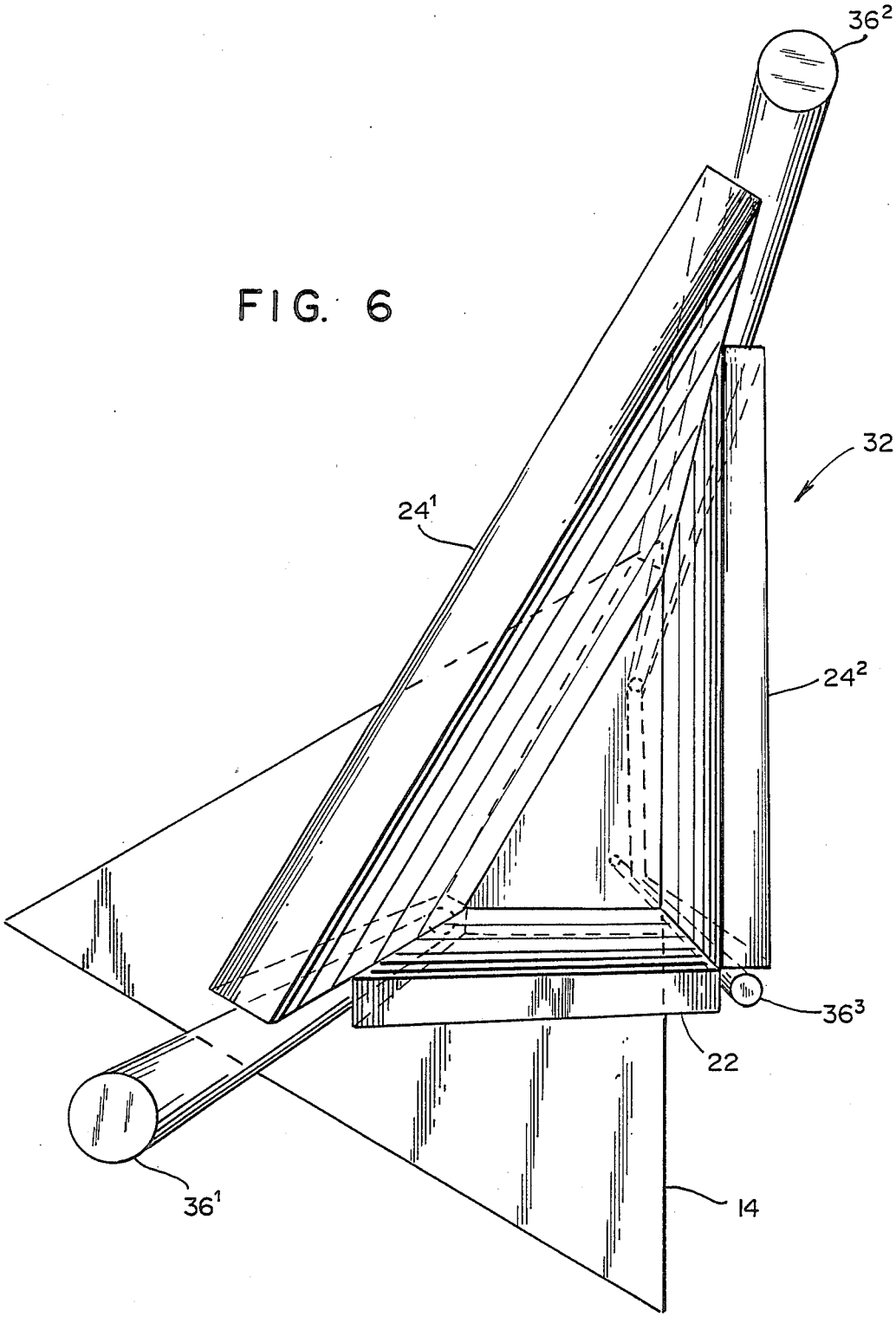
FIG. 6 is a perspective view of an enlarged scale showing a typical cellular enclosure as formed between two panel members, the wedge members and the column members.

For the purposes of further explanation of the cellular enclosures 32, the wedge members in FIG. 6 are designated as $24^1$, $24^2$. The wedge member $24^1$ extends from the panel 14 of the layer B to interconnect with the panel 18 (not shown) of the layer D. The wedge member $24^2$ extends from the panel 12 (not shown) of the layer A and connects with the panel 16 (not shown) of the layer C. Similarly the wedge member 22 spans between the panels 14 and 16 of the respective layers B and C. Thus a five-sided closed cell is created by the panel 14 of the layer B, the three wedge members $24^1$, $24^2$, and 22 and the panel 16 (not shown) of the layer C positioned on top of the wedge $24^2$ and the wedge 22, and flush with the side of the wedge $24^1$. It should also be noted that the optional column members 36 are designated as $36^1$, $36^2$, and $36^3$ in FIG. 6. The column members $36^1$, $36^2$, $36^3$, connect panel members having two intervening layers therebetween. For example, the column $36^1$ passes through interspace 20*c* and 20*d* and interconnects the panel member 14 within the layer B and the panel member within the layer E. The column $36^2$ spans between the layer A and the layer D; and the column $36^3$ extends to the layer C and originates from a layer below the layer A.

Although the geodesic structure 10 has been shown with the plurality of column members 36; these members are not critical to the support system, but can be included to add to the structural strength.

A central enclosure or core 34 is formed below layer A. Although the geodesic structure 10 has been described as having a spherical shape wherein the core 34 is surrounded by the layer A, it should be understood that this construction is applicable to other curved surfaces.

The geodesic structure 10 can be constructed with as few as three concentric polyhedral layers A, B, C in which case the column members 26 would not be needed. By increasing the number of layers however, and by incorporating the column members 36 in conjunction with the wedge members 22, 24, the number of cells 32 can be increased with an increase in the interior volume and structural integrity.

It should also be understood that the wedge members 22, 24 and column members 36 can be glued, welded, or otherwise attached to the panel members.

The interrelationship between several polyhedral layers A, B, C, D etc. will now be explained in further detail. As was previously discussed, the layer A is generated from a tessellation of a curved surface. For the purpose of this illustration, the layer A as shown in FIG. 1 is a hemisphere composed of variously shaped pentagons. It should of course be understood that a true convex polyhedron in this form would have the facial panels in abutting contact. As was described in conjunction with this structure an innermost layer and an outermost layer may have the panel members in abutting contact.

The layer B which is concentric to the layer A is generated using a combination of either a truncation or a stellation transformation of the parental layer A. Various combinations of truncations and stellations were described in the publication entitled, *Space Structures* (supra). These include edge truncation, vertex truncation, duality, vertex truncation of the dual, degenerate truncation, and special truncation. The stellation transformations include edge stellation, face stellation, duality, face stellation of the dual, degenerate stellation, and special stellation.

For the purpose of this illustrative embodiment the layer B is comprised of the panel members 14 which are related to the panel members 12 of the layer A through duality either by truncation or stellation. The panel members 16 of the layer C are related to the layer B by degenerate stellation. The three layers A, B and C can be repeated on larger scales as in FIG. 2, or more complex layers may be obtained. A fourth unique layer can be derived, for example, from the layer A by degenerate truncation.

The procedure for generating these surface layers A, B, C, etc. will be next described as follows:

1. A tessellation is chosen for a first curved surface.
2. A second tessellation of the same surface or of a second curved surface is obtained.
3. A third tessellation is similarly developed. Preferably the three tessellations have a relationship to one another rather than being randomly generated.
4. An ordering of the tessellations is determined going from an innermost layer to an outermost layer.
5. Each of the tessellations of the curved surface is replaced by an approximating polyhedral surface. It should be noted that a panel member will increase in size as the radially outward distance increases. The procedure can theoretically be continued indefinitely in an unending sequence of tessellations.
6. Additional, more complex tessellations can be derived from the three initial tessellations in order to keep individual panel sizes within reason while increasing the radial distance of subsequent layers.

It should thus be seen that the geodesic structure of this invention provides an improved construction and that it is well adapted to meet the conditions of practical use. Since various possible embodiments may be made of the present invention and further changes may be made in the exemplary embodiments set forth herein, it is to be understood that all materials set forth or shown in the accompanying drawings are to be interpreted as illustrative and not in a limiting sense.

Having thus described the invention, there is claimed as new and desired to be secured by Letters Patent:

1. A geodesic structure comprising at least three concentric surface layers, said layers being defined by planar panel members, said panel members of each layer approximating a polyhedral surface, each of the surface layers being related through geometric transformation further including support means for interconnecting the panel members of a first surface layer with the panel members of an adjacent surface layer and with the panel members of a non-adjacent surface layer.

2. A geometric structure as claimed in claim 1 wherein the surface layers are related through selected truncations and stellations of the polyhedral surfaces.

3. A geodesic structure as claimed in claim 1 wherein the support means includes wedge members, said wedge members extending between non-parallel panel members of at least two respective surface layers.

4. A geodesic structure as claimed in claim 3 further including column members said column members extending between at least two parallel panel members of respective surface layers.

5. A geodesic structure as claimed in claim 1 wherein the panel members define polygons.

6. A geodesic structure as claimed in claim 3 wherein the panel members lying within a surface layer are spaced apart to define a interspace therebetween.

7. A geodesic structure as claimed in claim 6 wherein said wedge members are positionable within said interspace.

8. A geodesic structure as claimed in claim 1 wherein a innermost polyhedral surface includes panel members in abutting edge contact.

9. A geodesic structure as claimed in claim 1 wherein an outermost polyhedral surface includes panel members in abutting edge contact.

10. A geodesic structure as claimed in claim 1 wherein additional surface layers may be selectively added in a radially outward direction.

11. A geodesic structure as claimed in claim 1 wherein additional layers may be selectively added in a radially inward direction.

12. A geodesic structure as claimed in claim 1 wherein a first surface layer is generated by a tessellation of a first curved surface.

13. A geodesic structure as claimed in claim 12 wherein a second surface layer is generated by a second tessellation of said first curved surface.

14. A geodesic structure as claimed in claim 12 wherein a second surface layer is generated by a first tessellation of second curved surface.

15. A geodesic structure as claimed in claim 3 wherein an enclosure is defined between the wedge members, and the panel members of two respective surface layers.

16. A geodesic structure comprising at least three consecutive non-intersecting surface layers, said surface layers being defined by planar panel members, said panel members of each layer approximating a polyhedral surface, each surface being related through geometric transformation further including support means for interconnecting panel members of at least two consecutive surface layers, said support means further interconnecting panel members of at least two non-consecutive surface layers.

* * * * *